US011710889B2

(12) United States Patent
Ryu et al.

(10) Patent No.: US 11,710,889 B2
(45) Date of Patent: Jul. 25, 2023

(54) ANTENNA DEVICE AND DISPLAY DEVICE INCLUDING THE SAME

(71) Applicants: DONGWOO FINE-CHEM CO., LTD., Jeollabuk-do (KR); POSTECH RESEARCH AND BUSINESS DEVELOPMENT FOUNDATION, Gyeongsangbuk-do (KR)

(72) Inventors: Han Sub Ryu, Gyeongsangbuk-do (KR); Yun Seok Oh, Gyeonggi-do (KR); Yoon Ho Huh, Seoul (KR); Won Bin Hong, Seoul (KR)

(73) Assignees: DONGWOO FINE-CHEM CO., LTD., Jeollabuk-Do (KR); POSTECH RESEARCH AND BUSINESS DEVELOPMENT FOUNDATION, Gyeongsangbuk-Do (KR)

( * ) Notice: Subject to any disclaimer, the term of this patent is extended or adjusted under 35 U.S.C. 154(b) by 111 days.

(21) Appl. No.: 17/019,527

(22) Filed: Sep. 14, 2020

(65) Prior Publication Data

US 2020/0411959 A1 Dec. 31, 2020

Related U.S. Application Data

(63) Continuation of application No. PCT/KR2019/002929, filed on Mar. 14, 2019.

(30) Foreign Application Priority Data

Mar. 14, 2018 (KR) ..... 10-2018-0029804
Sep. 21, 2018 (KR) ..... 10-2018-0113445

(51) Int. Cl.
*H01Q 1/24* (2006.01)
*H01Q 1/48* (2006.01)
(Continued)

(52) U.S. Cl.
CPC ..... *H01Q 1/243* (2013.01); *H01Q 1/36* (2013.01); *H01Q 1/48* (2013.01); *H01Q 9/0407* (2013.01)

(58) Field of Classification Search
CPC ..... H01Q 1/243; H01Q 1/36; H01Q 1/48; H01Q 9/0407
See application file for complete search history.

(56) References Cited

U.S. PATENT DOCUMENTS

2006/0170597 A1* 8/2006 Kurashima ..... H01Q 1/242 343/795
2010/0134376 A1* 6/2010 Margomenos ..... H01Q 21/065 343/860
(Continued)

FOREIGN PATENT DOCUMENTS

CN 102097675 A 6/2011
CN 102823149 A 12/2012
(Continued)

OTHER PUBLICATIONS

Office action dated Jan. 25, 2022 from Korean Patent Office in a counterpart Korean Patent Application No. 10-2018-0113445 (all the cited references are listed in this IDS.) (English translation is also submitted herewith.).
(Continued)

*Primary Examiner* — Hoang V Nguyen
(74) *Attorney, Agent, or Firm* — The PL Law Group, PLLC

(57) ABSTRACT

An antenna device according to an embodiment of the present invention includes a dielectric layer, a radiation pattern disposed on a top surface of the dielectric layer, a signal pad electrically connected to the radiation pattern, and a ground pad spaced apart from the signal pad and having an isolation space. A length of the isolation space is greater than a length of the signal pad.

11 Claims, 8 Drawing Sheets

(51) Int. Cl.
*H01Q 9/04* (2006.01)
*H01Q 1/36* (2006.01)

(56) References Cited

U.S. PATENT DOCUMENTS

| | | | | |
|---|---|---|---|---|
| 2011/0260943 | A1 | 10/2011 | Felic et al. | |
| 2016/0190678 | A1* | 6/2016 | Hong | H01Q 1/44 343/700 MS |
| 2016/0336649 | A1* | 11/2016 | Yu | H01Q 1/48 |
| 2019/0207286 | A1* | 7/2019 | Moallem | H05K 1/0253 |
| 2022/0094059 | A1* | 3/2022 | Wang | H01Q 5/28 |

FOREIGN PATENT DOCUMENTS

| | | | | | |
|---|---|---|---|---|---|
| CN | 107453047 | A | * | 12/2017 | H01Q 1/1271 |
| JP | 2006197072 | A | * | 7/2006 | H01Q 9/18 |
| JP | 6604552 | B2 | * | 3/2016 | |
| JP | 2017-092783 | A | | 5/2017 | |
| JP | 2017-175540 | A | | 9/2017 | |
| KR | 10-2008-0050267 | A | | 6/2008 | |
| KR | 10-2009-0008783 | A | | 1/2009 | |
| KR | 10-2011-0071368 | A | | 6/2011 | |
| KR | 10-2011-0102737 | A | | 9/2011 | |
| KR | 10-2013-0095451 | A | | 8/2013 | |
| KR | 10-2016-0027446 | A | | 3/2016 | |
| KR | 20160027446 | A | * | 3/2016 | H01Q 7/00 |

OTHER PUBLICATIONS

International Search Report for PCT/KR2019/002929 dated Jul. 8, 2019.

Office action dated Jul. 20, 2022 from Korean Patent Office in a counterpart Korean Patent Application No. 10-2018-0113445 (all the cited references are listed in this IDS.) (English translation is also submitted herewith.).

* cited by examiner

ANTENNA DEVICE AND DISPLAY DEVICE INCLUDING THE SAME

CROSS REFERENCE TO RELATED APPLICATIONS AND CLAIM OF PRIORITY

The present application is a continuation application to International Application No. PCT/KR2019/002929 with an International Filing Date of Mar. 14, 2019, which claims the benefit of Korean Patent Applications No. 10-2018-0029804 filed on Mar. 14, 2018 and No. 10-2018-0113445 filed on Sep. 21, 2018 at the Korean Intellectual Property Office, the disclosures of which are incorporated by reference herein in their entirety.

BACKGROUND

1. Field

The present invention relates to an antenna device and a display device including the same. More particularly, the present invention relates to an antenna device including an electrode pattern and a display device including the same.

2. Description of the Related Art

As information technologies have been developed, a wireless communication technology such as Wi-Fi, Bluetooth, etc., is combined with a display device in, e.g., a smartphone form. In this case, an antenna may be combined with the display device to provide a communication function.

As mobile communication technologies have been rapidly developed, an antenna capable of operating a high or ultra-high frequency communication is needed in the display device.

For example, in a recent 5G high frequency band communication, as a wavelength becomes shorter, a signal transmission and reception may be easily blocked. Further, a signal loss or a signal shielding may occur due to a narrow frequency band. Accordingly, demands of the high or ultra-high frequency antenna having desired directivity, gain and signal efficiency are increasing.

Additionally, as the display device equipped with the antenna becomes thinner and light-weighted, a space for the antenna may be also decreased. Accordingly, an antenna device capable of being inserted as a patch in the thin-type display device is being developed. In the antenna device, conductive structures such as a radiation pattern, a ground pad, a transmission line, etc., may be disposed at the same layer or at the same level. When the conductive structures are adjacent to each other in a limited area, a signal loss may be caused by a mutual noise and interference.

SUMMARY

According to an aspect of the present invention, there is provided an antenna device having improved signaling efficiency and reliability.

According to an aspect of the present invention, there is provided a display device including an antenna device with signaling efficiency and reliability.

(1) An antenna device, including: a dielectric layer; a radiation pattern disposed on a top surface of the dielectric layer; a signal pad electrically connected to the radiation pattern; and a ground pad spaced apart from the signal pad and having an isolation space, wherein a length of the isolation space is greater than a length of the signal pad.

(2) The antenna device according to the above (1), wherein the ground pad includes: a pair of protruding bars extending in a length direction of the antenna device and facing each other in a width direction of the antenna device; and a connection bar extending in the width direction and connecting the protruding bars.

(3) The antenna device according to the above (2), wherein the connection bar is connected to end portions of the protruding bars to define a recess, and the signal pad is disposed at an inlet of the recess.

(4) The antenna device according to the above (3), wherein the isolation space is defined by an area of the recess except for the inlet at which the signal pad is disposed.

(5) The antenna device according to the above (4), wherein a width of the isolation space is the same as a distance between the pair of protruding bars.

(6) The antenna device according to the above (3), further including a transmission line connecting the radiation pattern and the signal pad.

(7) The antenna device according to the above (6), wherein the signal pad is only inserted into the inlet of the recess, and the transmission line is disposed at an outside of the recess.

(8) The antenna device according to the above (6), wherein the radiation pattern, the transmission line, the signal pad and the ground pad are disposed at the same level on the top surface of the dielectric layer.

(9) The antenna device according to the above (8), further including a ground layer disposed on a bottom surface of the dielectric layer.

(10) The antenna device according to the above (1), wherein the ground pad includes a pair of bar patterns spaced apart from each other and extending with the signal pad interposed therebetween.

(11) The antenna device according to the above (10), wherein the length of the isolation space is obtained by subtracting the length of the signal pad from a length of the bar pattern.

(12) The antenna device according to the above (1), wherein the length of the isolation space is 2 to 300 times the length of the signal pad.

(13) The antenna device according to the above (12), wherein the length of the signal pad is from 50 μm to 700 μm, and the length of the isolation space is from 200 μm to 3 mm.

(14) The antenna device according to the above (1), wherein the radiation pattern has a mesh structure.

(15) The antenna device according to the above (14), further including a dummy pattern arranged around the radiation pattern and including a mesh structure having the same shape as that of the radiation pattern.

(16) A display device comprising the antenna device according to embodiments as described above.

An antenna device according to embodiments of the present invention may include a signal pad electrically connected to a radiation pattern, and a ground pad spaced apart from the signal pad. The ground pad may include a recess into which the signal pad is inserted. Accordingly, noises around the signal pad may be effectively shielded by the ground pad.

In exemplary embodiments, the ground pad may have an isolation space greater than a length of the signal pad. An isolation distance between the ground pad and the signal pad may be obtained by the isolation space, so that a signal loss due to a self-radiation of the ground pad may be prevented.

The antenna device may be applied to a display device including a mobile communication device capable of signaling in a high frequency or ultrahigh frequency band, thereby improving optical properties such as a transmittance and radiation properties.

DETAILED DESCRIPTION OF THE EMBODIMENTS

According to exemplary embodiments of the present invention, there is provided an antenna device including a radiation pattern, a signal pad and a ground pad that may include a recess into which the signal pad is inserted.

The antenna device may be, e.g., a microstrip patch antenna fabricated in the form of a transparent film. For example, the antenna device may be applied to a device for high frequency band or ultra-high frequency band (e.g., 3G, 4G, 5G or more) mobile communications.

According to exemplary embodiments of the present invention, there is also provided a display device including the antenna device. However, an application of the antenna device is not limited to the display device, and the antenna device may be applied to various objects or structures such as a vehicle, a home electronic appliance, an architecture, etc.

Hereinafter, the present invention will be described in detail with reference to the accompanying drawings. However, those skilled in the art will appreciate that such embodiments described with reference to the accompanying drawings are provided to further understand the spirit of the present invention and do not limit subject matters to be protected as disclosed in the detailed description and appended claims.

Figure 1:
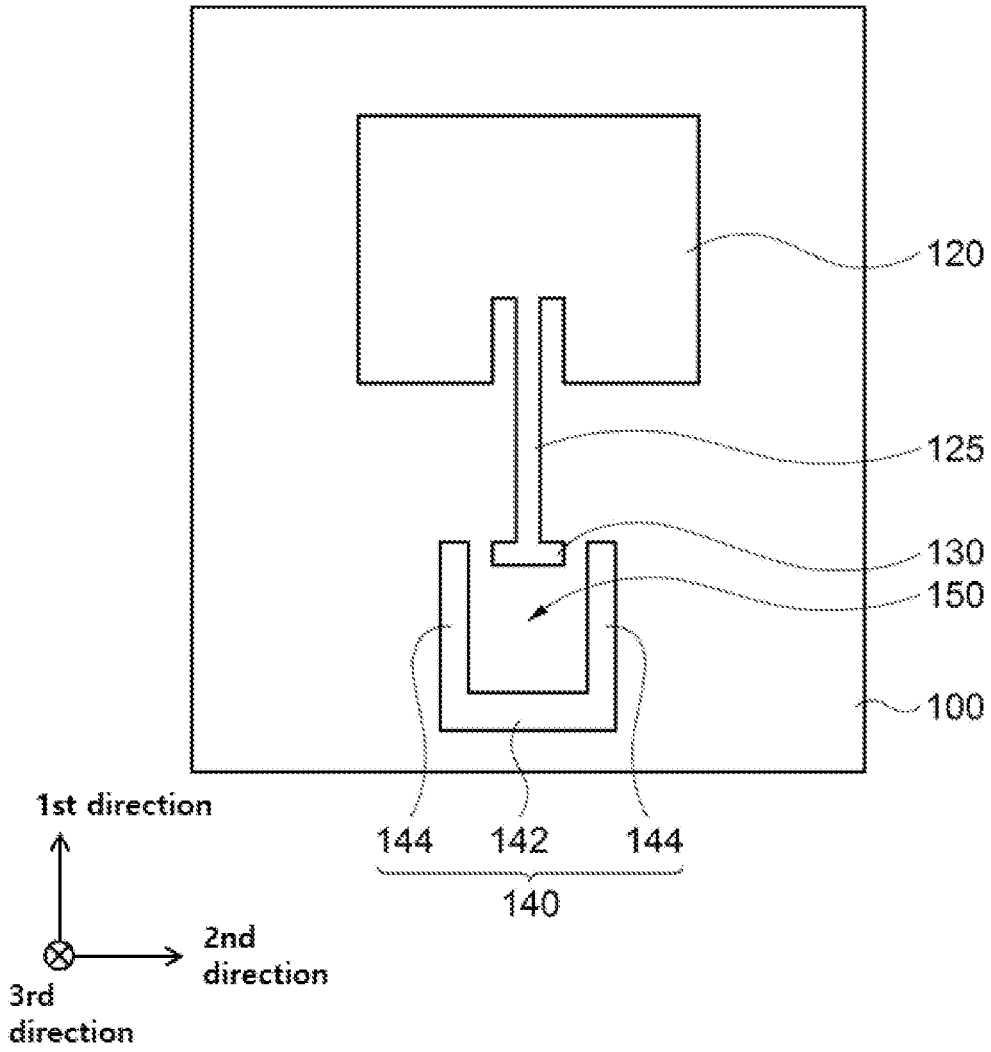
FIGS. 1 and 2 are a schematic top planar view and a schematic cross-sectional view, respectively, illustrating an antenna device in accordance with exemplary embodiments.
Figure 2:
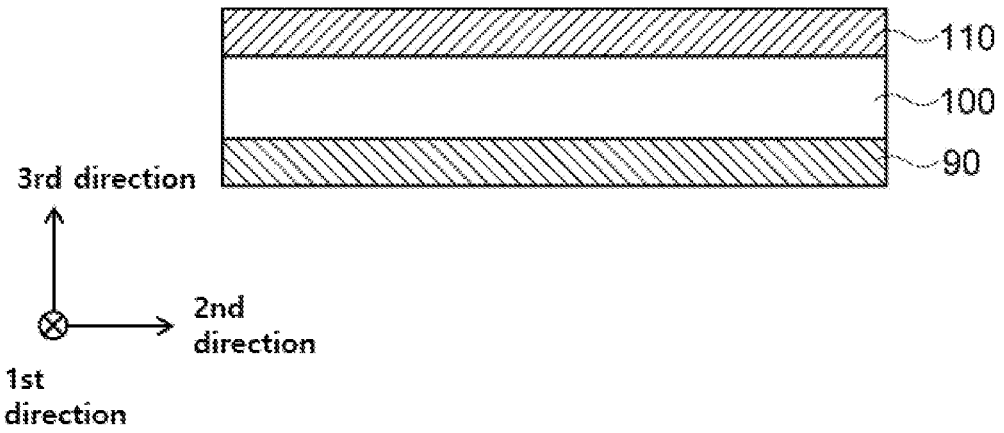

FIGS. 1 and 2 are a schematic top planar view and a schematic cross-sectional view, respectively, illustrating an antenna device in accordance with exemplary embodiments.

In FIGS. 1 and 2, two directions that are parallel to a top surface of the dielectric layer 100 and cross each other are defined as a first direction and a second direction. For example, the first direction and the second direction may cross each other perpendicularly. A direction vertical to the top surface of the dielectric layer 100 is defined as a third direction. For example, the first direction may correspond to a length direction of the antenna device, the second direction may correspond to a width direction of the antenna device, and the third direction may correspond to a thickness direction of the antenna device. The definition of the direction may be also applied to accompanying drawings.

Referring to FIG. 1, the antenna device may include a dielectric layer 100 and a first electrode layer 110 disposed on the dielectric layer 100. The antenna device may further include a second electrode layer 90 disposed under the dielectric layer 100.

The dielectric layer 100 may include, e.g., a transparent resin material capable of being folded. For example, the dielectric layer 100 may include a polyester-based resin such as polyethylene terephthalate, polyethylene isophthalate, polyethylene naphthalate and polybutylene terephthalate; a cellulose-based resin such as diacetyl cellulose and triacetyl cellulose; a polycarbonate-based resin; an acrylic resin such as polymethyl (meth)acrylate and polyethyl (meth)acrylate; a styrene-based resin such as polystyrene and an acrylonitrile-styrene copolymer; a polyolefin-based resin such as polyethylene, polypropylene, a cycloolefin or polyolefin having a norbornene structure and an ethylene-propylene copolymer; a vinyl chloride-based resin; an amide-based resin such as nylon and an aromatic polyamide; an imide-based resin; a polyethersulfone-based resin; a sulfone-based resin; a polyether ether ketone-based resin; a polyphenylene sulfide resin; a vinyl alcohol-based resin; a vinylidene chloride-based resin; a vinyl butyral-based resin; an allylate-based resin; a polyoxymethylene-based resin; an epoxy-based resin; a urethane or acryl urethane-based resin; a silicone-based resin, etc. These may be used alone or in a combination of two or more thereof.

In some embodiments, an adhesive film such as an optically clear adhesive (OCA), an optically clear resin (OCR), or the like may be included in the dielectric layer 100.

In some embodiments, the dielectric layer 100 may include an inorganic insulating material such as glass, silicon oxide, silicon nitride, silicon oxynitride, etc.

A capacitance or an inductance may be formed between the first electrode layer 110 and the second electrode layer 90 by the dielectric layer 100 so that a frequency band at which the antenna device may be driven or operated may be adjusted. In some embodiments, a dielectric constant of the dielectric layer 100 may be adjusted in a range from about 1.5 to about 12. When the dielectric constant exceeds about 12, a driving frequency may be excessively reduced so that an antenna driving in a desired high frequency band may not be realized.

The first electrode layer 110 may be disposed on a top surface of the dielectric layer 100. The first electrode layer 110 may include an antenna pattern of the antenna device.

In exemplary embodiments, the first electrode layer 110 may include a radiation pattern 120 and a ground pad 140. The first electrode layer 110 may further include a transmission line 125 branching from the radiation pattern 120 and a signal pad 130 disposed at an end portion of the transmission line 125.

As illustrated in FIG. 1, a width (e.g., a width in the second direction) of the signal pad 130 may be greater than that of the transmission line 125.

In some embodiments, the radiation pattern 120, the transmission line 125, the signal pad 130 and the ground pad 140 may all be located on the same plane or at the same level on the top surface of the dielectric layer 100.

For example, as illustrated in FIG. 1, the transmission line 125 may be branched from a central portion of the radiation pattern 120 to extend in the first direction. The signal pad 130 may be connected to an end portion of the transmission line 125 away from the radiation pattern 120.

In some embodiments, the radiation pattern 120, the transmission line 125 and the signal pad 130 may be substantially integrally connected to be provided as a single member.

The ground pad 140 may be disposed to be adjacent to the signal pad 130. The ground pad 140 may include protruding bars 144 facing each other and a connection bar 142. In some embodiments, a pair of the protruding bars 144 may be connected by one connection bar 142 to define a ground pad 140. The protruding bar 144 may extend in the first direction, and a pair of the protruding bars 144 may face each other in the second direction. The connection bar 142 may extend in the second direction and may physically and electrically connect the pair of the protruding bars 144 to each other. The connection bar 142 may be connected to end portions in the same direction of the protruding bars 144.

As illustrated in FIG. 1, the ground pad 140 may have a shape in which a groove is formed (e.g., a cup shape) in a planar view. Accordingly, the ground pad 140 may include a recess 150 defined by the protruding bars 144 and the connection bar 142.

In exemplary embodiments, the signal pad 130 may be inserted into an inlet portion of the recess 150. The signal pad 130 may face the connection bar 142 of the ground pad 140 in the first direction. The signal pad 130 may be physically or electrically spaced apart from the ground pad 140 to partially block the inlet portion of the recess 150.

In some embodiments, the signal pad 130 may substantially only enter the recess 150, and the transmission line 125 may not extend into the recess 150, and may be located at an outside of the recess 150.

As described above, the ground pad 140 may have a recessed structure, so that a vicinity of the signal pad 130 may be effectively surrounded by the ground pad 140. Accordingly, a transmission/reception noise around the signal pad 130 or an electrical noise generated from a display device to which the antenna element is applied may be more effectively shielded.

Additionally, the ground pad 140 and the signal pad 130 may be disposed such that the signal pad 130 may partially cap the inlet of the recess 150. Accordingly, an isolation space may be formed between the signal pad 130 and the connection bar 142 facing each other.

A length of the ground pad 140 may be increased by the isolation space, while preventing an excessive increase of a volume or an area of the ground pad 140. Accordingly, an appropriate area of the ground pad 140 may be obtained to reduce a resistance, while preventing radiation properties of the radiation pattern 120 from being degraded or interrupted by the ground pad 140.

As illustrated in FIG. 2, the second electrode layer 90 may be disposed on a bottom surface of the dielectric layer 100. In exemplary embodiments, the second electrode layer 90 may serve as a lower ground layer of the antenna device. For example, the second electrode layer 90 may cover the radiation pattern 120 in a planar view to serve as a ground electrode for forming a vertical polarization.

In some embodiments, a connection member (a contact, a via, a flexible circuit board (FPCB), etc.) may be provided to connect the second electrode layer 90 and the ground pad 140.

In some embodiments, the second electrode layer 90 may be included as a separate or independent element of the antenna device. In some embodiments, a conductive member of the display device to which the antenna device is applied may serve as a ground layer.

The conductive member may include, e.g., a gate electrode of a thin film transistor (TFT) included in a display panel, various wirings such as a scan line or a data line, or various electrodes such as a pixel electrode and a common electrode.

In an embodiment, e.g., various structures including a conductive material disposed under the display panel may serve as the second electrode layer 90. For example, a metal plate (e.g., a stainless steel plate such as a SUS plate), a pressure sensor, a fingerprint sensor, an electromagnetic wave shielding layer, a heat dissipation sheet, a digitizer, etc., may serve as the second electrode layer 90.

The first electrode layer 110 and the second electrode layer 90 may include silver (Ag), gold (Au), copper (Cu), aluminum (Al), platinum (Pt), palladium (Pd), chromium (Cr), titanium (Ti), tungsten (W), niobium (Nb), tantalum (Ta), vanadium (V), iron (Fe), manganese (Mn), cobalt (Co), nickel (Ni), zinc (Zn), tin (Sn), molybdenum (Mo), calcium (Ca) or an alloy containing at least one of the metals. These may be used alone or in combination thereof. For example, silver (Ag) or a silver alloy (e.g., a silver-palladium-copper (APC) alloy) may be used for implementing a low resistance.

In an embodiment, the first electrode layer 110 and the second electrode layer 90 may include copper (Cu) or a copper alloy in consideration of low resistance and pattern formation with a fine line width. For example, the first electrode layer 110 and the second electrode layer 90 may include a copper-calcium (Cu—Ca) alloy.

In some embodiments, the first and second electrode layers 110 and 90 may include a transparent metal oxide such as indium tin oxide (ITO), indium zinc oxide (IZO), indium zinc tin oxide (ITZO), zinc oxide (ZnOx), etc.

For example, the first and second electrode layers 110 and 90 may have a multi-layered structure including a metal or alloy layer and a transparent metal oxide layer.

In some embodiments, the first electrode layer 110 and the second electrode layer 90 may include the same conductive material (e.g., the metal and/or alloy). In some embodiments, the first electrode layer 110 and the second electrode layer 90 may include different conductive materials from each other. For example, the first electrode layer 110 may include the aforementioned metal or alloy, and the second electrode layer 90 may include the aforementioned transparent conductive oxide.

Figure 3:
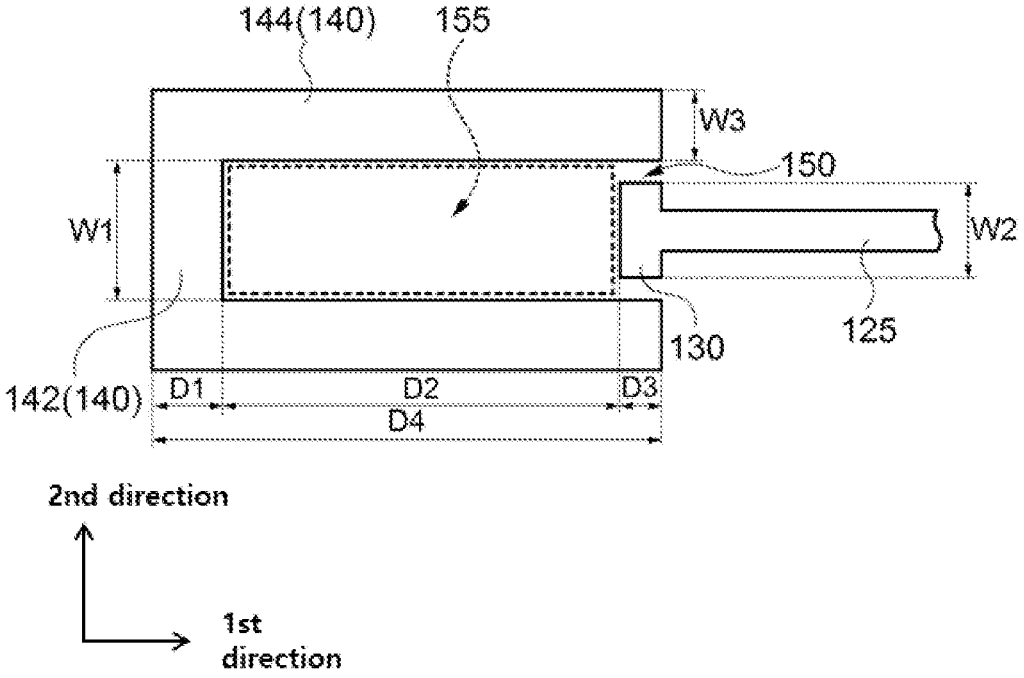
FIG. 3 is a schematic top planar view illustrating a construction of an antenna pattern in accordance with some exemplary embodiments.

FIG. 3 is a schematic top planar view illustrating a construction of an antenna pattern in accordance with some exemplary embodiments. For convenience of descriptions, an illustration of the dielectric layer and the radiation pattern is omitted herein.

Referring to FIG. 3, as described with reference to FIG. 1, the ground pad 140 may include a recess 150 defined by the protruding bars 144 facing in the second direction and the connection bar 142 extending in the first direction. The signal pad 130 may be disposed at the inlet of the recess 150.

In exemplary embodiments, an isolation space 155 may be defined by an area of the recess 150 excluding an area of the inlet where the signal pad 130 is located (e.g., an area indicated by a dotted rectangle in FIG. 3).

A length D4 of the ground pad 140 may be defined as a maximum distance in the first direction between the connection bar 142 and the protrusion bar 144. The length D4 of the ground pad 140 may be substantially defined as a sum of a length D1 of the connection bar 142, a length D2 of the isolation space 155 and a length D3 of the signal pad 130.

In an embodiment, the length D1 of the connection bar 142 may range from about 200 μm to about 3 mm.

In exemplary embodiments, the length D2 of the isolation space 155 may be greater than the length D3 of the signal pad 130. Accordingly, a feeding or a signal transmission/reception interference caused by a self-emission of the ground pad 140 may be prevented.

In some embodiments, the length D3 of the signal pad 130 may be in a range from about 50 μm to about 700 μm. The length D2 of the isolation space 155 may be in a range from about 200 μm to about 3 mm, preferably in a range from about 800 μm to about 3 mm. In an embodiment, the length D2 of the isolation space 155 may be about 1.1 to 60 times, preferably about 2 to 60 times the length of the signal pad 130. In this case, noises around the signal pad 130 may be effectively shielded or removed while preventing the self-emission of the ground pad 140.

To prevent a short-circuit with the signal pad 130, a distance W1 between the protruding bars 144 of the ground pad 140 may be greater than a width W2 of the signal pad 130. The distance W1 between the protruding bars 144 may be substantially the same as a width of the isolation space 155 (e.g., a width in the second direction).

In some embodiments, the width W2 of the signal pad 130 may be from about 10 μm to about 500 μm. The distance W1 between the protruding bars 144 may be from about 20 μm to about 1500 μm.

The protruding bar 144 may be formed to have a sufficient width for reducing a resistance of the ground pad 140 and improving an efficiency of a noise removal. In an embodiment, a width W3 (e.g., a width in the second direction) of the protruding bar 144 may be in a range from about 5 mm to about 20 mm.

As described above, according to exemplary embodiments, the length of the ground pad 140 and the width of the protruding bar 144 may be sufficiently increased to sufficiently achieve a noise removal effect through a resistance reduction. Further, the isolation space 155 may be formed while shielding a periphery of the signal pad 130 by the construction of the ground pad 140 having the recessed shape, thereby suppressing a radiation interference caused by the ground pad 140.

Accordingly, the antenna device having improved noise removal property and radiation reliability may be implemented.

Figure 4:
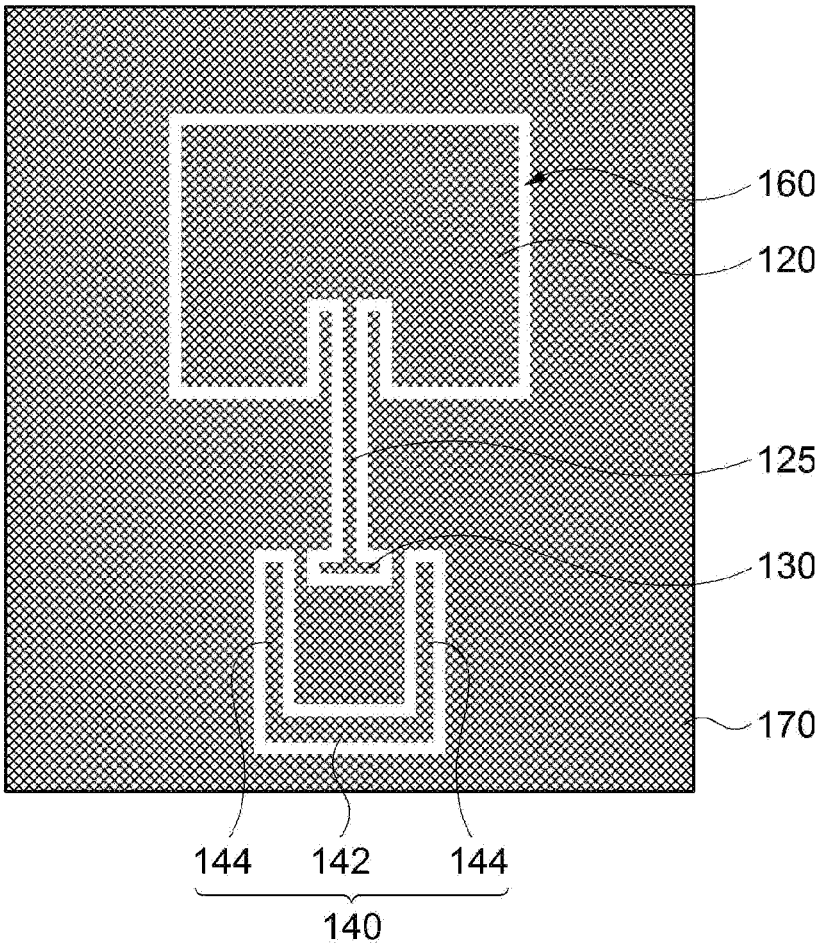
FIG. 4 is a schematic top planar view illustrating an antenna device in accordance with some exemplary embodiments.

FIG. 4 is a schematic top planar view illustrating an antenna device in accordance with some exemplary embodiments.

Referring to FIG. 4, the first electrode layer 110 (see FIG. 2) may include a mesh structure. According to exemplary embodiments, the antenna pattern including the radiation pattern 120, the transmission line 125, the signal pad 130 and the ground pad 140 may include the mesh structure. Accordingly, transmittance of the antenna device may be improved.

A dummy pattern 170 may be disposed on the dielectric layer 100 around the antenna pattern. In exemplary embodiments, the dummy pattern 170 may include a mesh structure having substantially the same shape as that of the antenna pattern. An arrangement of electrodes around the antenna pattern may become uniform by the dummy pattern 170 to prevent the mesh structure or electrode lines included therein from being visually recognized by a user of a display device to which the antenna device is applied.

For example, a metal layer may be formed on the dielectric layer 100, and the metal layer may be etched to form the mesh structure while being cut along a boundary of the antenna pattern to form a separation region 160. Accordingly, the dummy pattern 170 may be electrically and physically separated from the antenna pattern.

Figure 5:
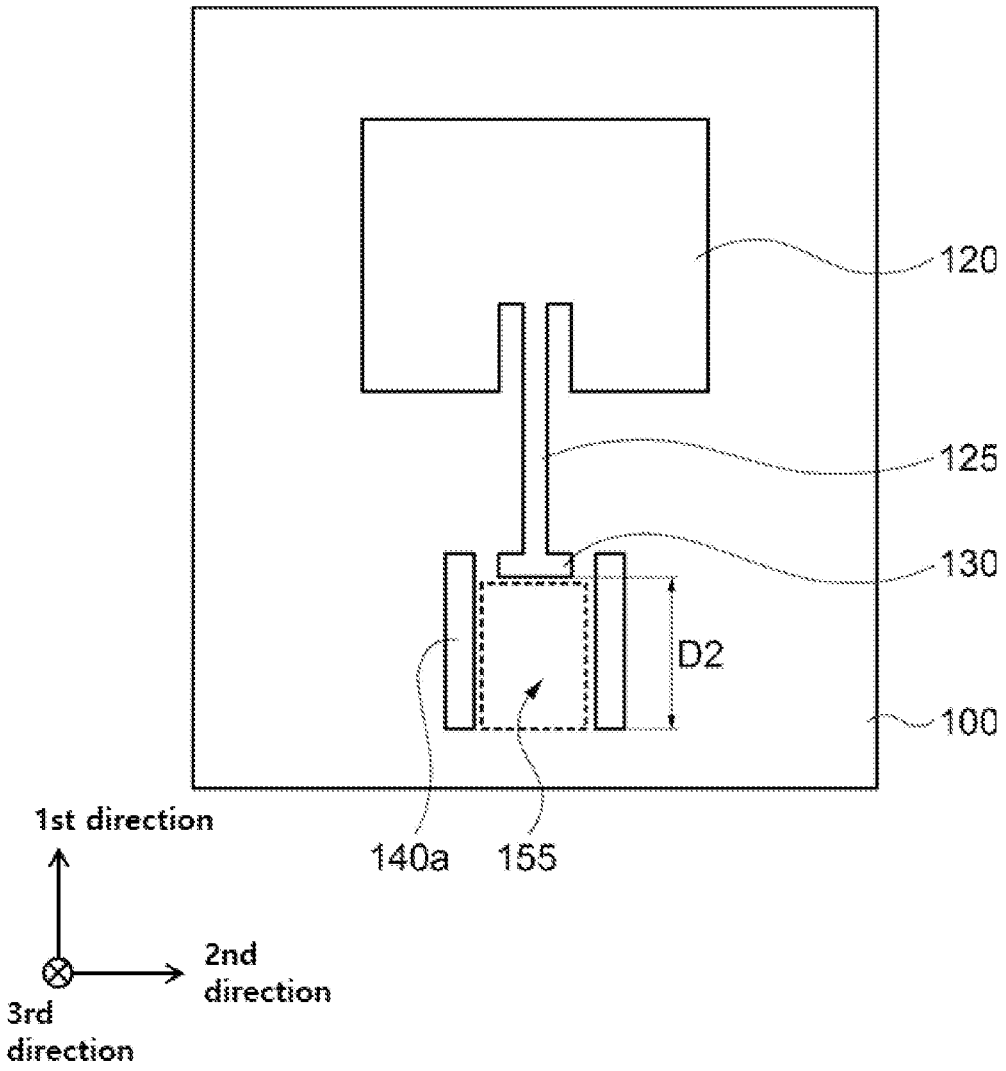
FIG. 5 is a schematic top planar view illustrating an antenna device in accordance with some exemplary embodiments.

FIG. 5 is a schematic top planar view illustrating an antenna device in accordance with some exemplary embodiments. Detailed descriptions on elements and/or structures substantially the same as or similar to those described with reference to FIG. 1 are omitted herein.

Referring to FIG. 5, a pair of ground pads 140*a* may be disposed with the signal pad 130 interposed therebetween.

For example, the connection bar 142 as illustrated in FIG. 1 may be omitted from the ground pad 140. In this case, the ground pad 140*a* may include bar patterns that may be physically separated and may be in parallel with each other with the signal pad 130 interposed therebetween.

Accordingly, an isolation space 155 may have an opened shape, and a length of the isolation space 155 may indicate a vertical distance from an end of the ground pad 140*a* to a position corresponding to an end of the signal pad 130 in the first direction.

For example, the length of the isolation space 155 may be substantially defined as a value obtained by subtracting the length of the signal pad 130 from the length of the ground pad 140*a*.

Figure 6:
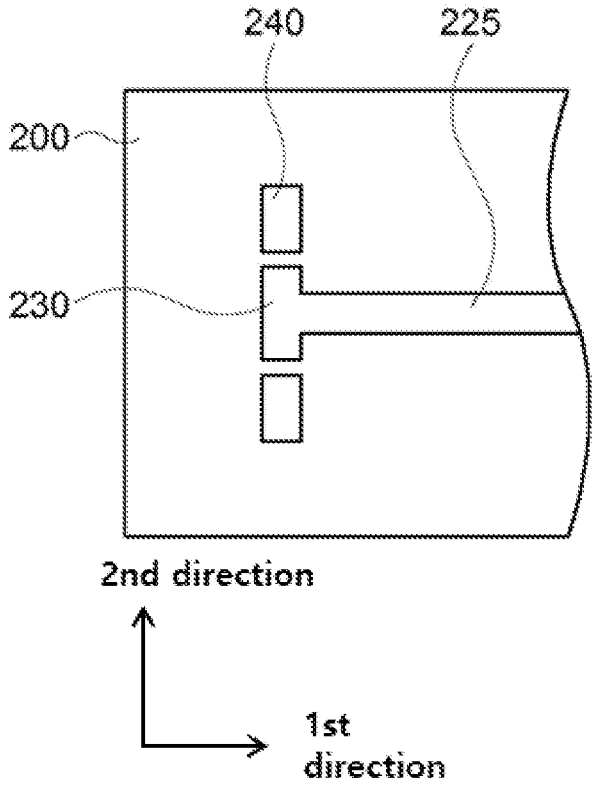
FIGS. 6 and 7 are schematic top planar views illustrating a construction of an antenna pattern in accordance with comparative examples.
Figure 7:
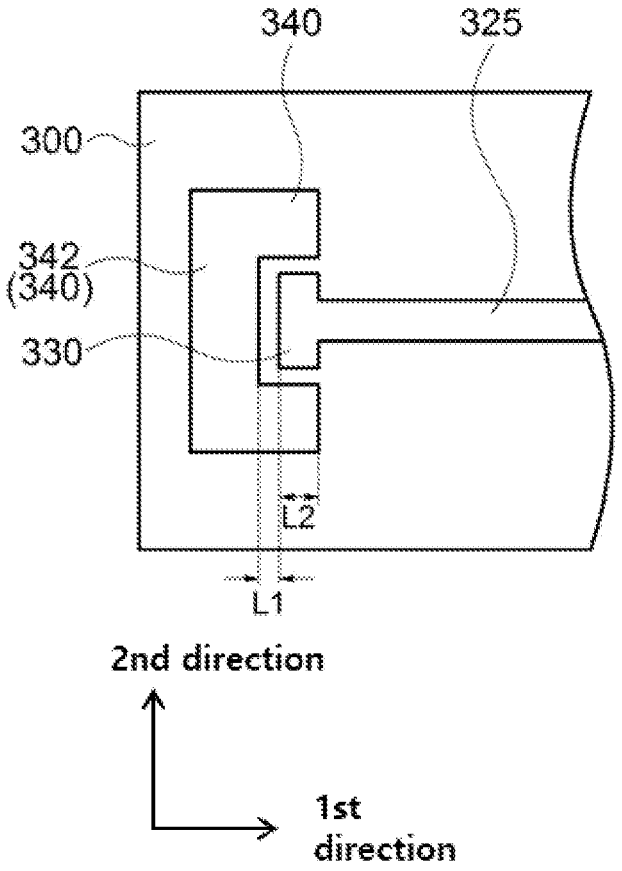

FIGS. 6 and 7 are schematic top planar views illustrating a construction of an antenna pattern in accordance with comparative examples.

Referring to FIG. 6, in a comparative example, a signal pad 230, a transmission line 225 and a radiation pattern (not illustrated) may be disposed on a dielectric layer 200. A pair of ground pads 240 may be disposed to be adjacent to both sides in the second direction of the signal pad 230 connected to an end of the transmission line 225.

In the comparative example illustrated in FIG. 6, a pair of the ground pads 240 having an island pattern shape independent from each other are disposed with the signal pad 230 interposed therebetween. In this case, a sufficient noise shielding effect may not be achieved compared to that from the exemplary embodiments having a recessed ground pad.

Referring to FIG. 7, a signal pad 330, a transmission line 325, a radiation pattern (not illustrated) and a ground pad 340 may be disposed on a dielectric layer 300. The ground pad 340 may include a recess into which the signal pad 330 is inserted.

In the comparative example illustrated in FIG. 7, the signal pad 330 may be disposed to be excessively close to the connection bar 342 of the ground pad 340. In this case, a length L2 of the signal pad 330 may be smaller than a distance L1 between the signal pad 330 and the connection bar 342.

In the case of the comparative example of FIG. 7, a sufficient isolation space is not achieved, and thus feeding and radiation properties in the signal pad 330 and the radiation pattern may be interfered due to a self-emission of the ground pad 340. Accordingly, an overall gain and signaling efficiency of the antenna device may be degraded.

However, according to exemplary embodiments as described with reference to FIGS. 1 to 5, a length or an area of the ground pad may be increased while maintaining the sufficient isolation space (e.g., the length of the isolation space is greater than the length of the signal pad). Accordingly, a noise removal efficiency may be improved without impairing reliability in the radiation pattern and signal pad.

Figure 8:
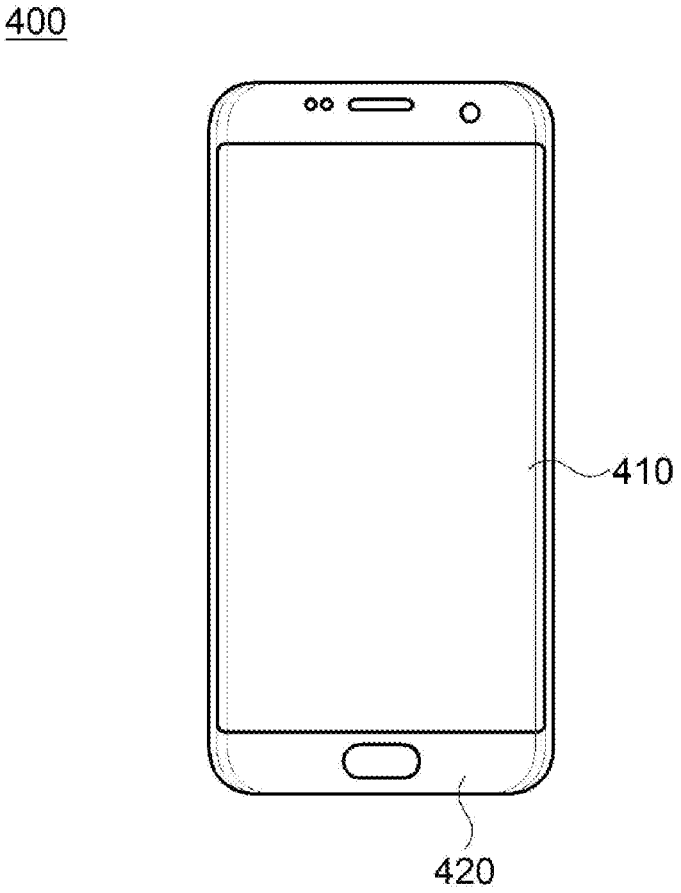
FIG. 8 is a schematic top planar view illustrating a display device in accordance with exemplary embodiments.

FIG. 8 is a schematic top planar view illustrating a display device in accordance with exemplary embodiments. For example, FIG. 8 illustrates an outer shape including a window of a display device.

Referring to FIG. 8, a display device 400 may include a display area 410 and a peripheral area 420. The peripheral area 420 may be disposed on, e.g., both lateral portions and/or both end portions of the display area 410.

In some embodiments, the above-described antenna device may be inserted in the peripheral area 420 of the display device 400 as a patch or a film shape. In some embodiments, the radiation pattern and the second electrode layer of the antenna device may be disposed to at least partially correspond to the display area 410.

The peripheral area 420 may correspond to, e.g., a light-shielding portion or a bezel portion of an image display device. An integrated circuit (IC) chip for controlling driving and radiation properties of the antenna device and supplying a feeding signal may be disposed in the peripheral area 420.

In some embodiments, the IC chip may supply the feeding signal through the signal pad 130 of the antenna device. In this case, the signal pad 130 may be disposed to be adjacent to the peripheral area 420, so that a signal transmission/reception path may be shortened and a signal loss may be suppressed.

Figure 9:
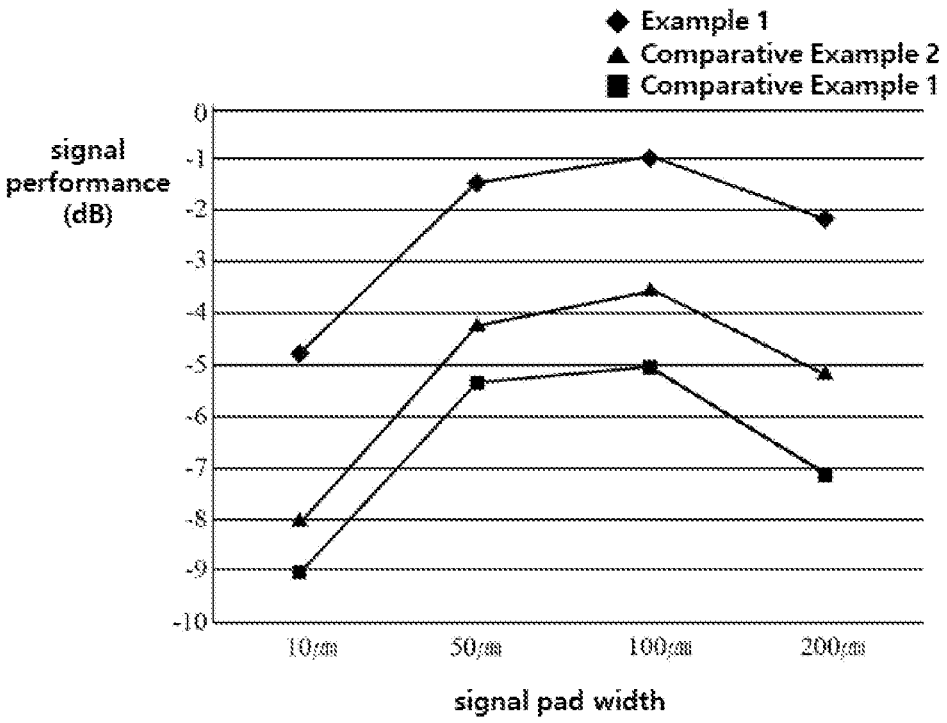
FIG. 9 is a graph showing signaling performances of antenna patterns of Example and Comparative Examples.

FIG. 9 is a graph showing signaling performances of antenna patterns of Example and Comparative Examples.

Specifically, in Example 1, a signaling performance was measured using the antenna pattern designed as illustrated in FIG. 3. In Comparative Example 1, a signaling performance was measured using the antenna pattern designed as illustrated in FIG. 6. In Comparative Example 2, a signaling performance was measured using the antenna pattern designed as illustrated in FIG. 7.

Example 1

An antenna pattern including copper was formed on a COP dielectric layer, and a size of the antenna pattern in Example 1 is as follows (see FIG. 3).

Length of signal pad 130 (D3): 0.7 mm

Width of signal pad 130 (W2): 10 μm/50 μm/100 μm/200 μm

Length of transmission line 125: 2 mm

Pattern width of ground pad W1: 1.1 mm

Pattern width of ground pad W3: 10 mm

Length of isolation space length D2: 980 μm

Comparative Example 1

An antenna pattern including copper was formed on the same dielectric layer as that in Example 1 (see FIG. 6).

A ground pad having a size of 100 μm*50 μm was formed at each of both sides of the signal pad 230 having the same size as that in Example 1.

Comparative Example 2

An antenna pattern having the same structure as that in Example 1 except that the length of the isolation space was 20 μm was formed as illustrated in FIG. 7.

Referring to FIG. 9, signal performances (dB) were measured while changing the width of the signal pad (10 μm/50 μm/100 μm/200 μm).

Specifically, a first port and a second port included in Network Analyzer were each connected, and a line loss was measured as S21 value using S-Parameter.

For example, S21 for achieving an output of 50% or more with an input of 100% may be set to about −3 dB by the following equation.

$$S21(dB)=10*\text{Log}\ (\text{Output Intensity}/\text{Input Intensity}) \quad \text{[Equation]}$$

The signal performance in Comparative Example 2 having the recessed ground pad was slightly greater than that in Comparative Example 1. The signal performance was remarkable improved by increasing the length of the isolation space in Example 1.

What is claimed is:

1. An antenna device, comprising:

a dielectric layer;

a radiation pattern disposed on a top surface of the dielectric layer;

a signal pad electrically connected to the radiation pattern; and a ground pad spaced apart from the signal pad and having an isolation space, wherein a length of the isolation space is greater than a length of the signal pad, wherein the length of the isolation space is 2 to 300 times the length of the signal pad, wherein the ground pad comprises:

a pair of protruding bars extending in a length direction of the antenna device and facing each other in a width direction of the antenna device; and a connection bar extending in the width direction and connecting the protruding bars.

2. The antenna device according to claim 1, wherein the connection bar is connected to end portions of the protruding bars to define a recess, and the signal pad is disposed at an inlet of the recess.

3. The antenna device according to claim 2, wherein the isolation space is defined by an area of the recess except for the inlet at which the signal pad is disposed.

4. The antenna device according to claim 3, wherein a width of the isolation space is the same as a distance between the pair of protruding bars.

5. The antenna device according to claim 2, further comprising a transmission line connecting the radiation pattern and the signal pad.

6. The antenna device according to claim 5, wherein the signal pad is only inserted into the inlet of the recess, and the transmission line is disposed at an outside of the recess.

7. The antenna device according to claim 5, wherein the radiation pattern, the transmission line, the signal pad and the ground pad are disposed at the same level on the top surface of the dielectric layer.

8. The antenna device according to claim 7, further comprising a ground layer disposed on a bottom surface of the dielectric layer.

9. The antenna device according to claim 1, wherein the radiation pattern has a mesh structure.

10. The antenna device according to claim 9, further comprising a dummy pattern arranged around the radiation pattern and including a mesh structure having the same shape as that of the radiation pattern.

11. A display device comprising the antenna device according to claim 1.

* * * * *